US011590769B2

(12) United States Patent
Motai et al.

(10) Patent No.: US 11,590,769 B2
(45) Date of Patent: Feb. 28, 2023

(54) TAPE PRINTING DEVICE

(71) Applicant: SEIKO EPSON CORPORATION, Tokyo (JP)

(72) Inventors: Kenji Motai, Matsumoto (JP); Hirosuke Yasuki, Matsumoto (JP); Keisuke Taruya, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/488,949

(22) Filed: Sep. 29, 2021

(65) Prior Publication Data

US 2022/0097412 A1 Mar. 31, 2022

(30) Foreign Application Priority Data

Sep. 30, 2020 (JP) ..... JP2020-165273

(51) Int. Cl.

| | |
|---|---|
| ***B41J 3/407*** | (2006.01) |
| ***B41J 11/04*** | (2006.01) |
| ***B41J 15/04*** | (2006.01) |
| ***B41J 2/325*** | (2006.01) |

(52) U.S. Cl.

CPC ..... *B41J 3/4075* (2013.01); *B41J 2/325* (2013.01); *B41J 11/04* (2013.01); *B41J 15/044* (2013.01)

(58) Field of Classification Search

CPC . B41J 15/044; B41J 11/04; B41J 2/325; B41J 3/4075

See application file for complete search history.

(56) References Cited

U.S. PATENT DOCUMENTS

| | | | | |
|---|---|---|---|---|
| 2005/0024463 | A1* | 2/2005 | Kida | B41J 3/60 347/104 |
| 2007/0110491 | A1* | 5/2007 | Vandermeulen | B41J 2/325 400/55 |
| 2010/0321458 | A1* | 12/2010 | Takeda | B41J 25/316 400/242 |
| 2011/0222950 | A1* | 9/2011 | Sato | B41J 11/485 400/621 |
| 2016/0185136 | A1* | 6/2016 | Ng | B41J 3/4075 347/220 |
| 2018/0162141 | A1* | 6/2018 | Wong | B41J 29/13 |
| 2019/0240990 | A1* | 8/2019 | Seki | B41J 29/38 |

FOREIGN PATENT DOCUMENTS

| | | | |
|---|---|---|---|
| JP | 06320838 | A | * 11/1994 |
| JP | 2002-166606 | A | 6/2002 |
| JP | 2003-175634 | A | 6/2003 |
| JP | 2007-301910 | A | 11/2007 |

* cited by examiner

*Primary Examiner* — David H Banh
(74) *Attorney, Agent, or Firm* — Oliff PLC

(57) ABSTRACT

A tape printing device includes a platen shaft that engages with a platen roller; a thermal head that prints on a tape sandwiched with the platen roller engaged with the platen shaft; a head holder that has a rotating shaft and rotatably holds the thermal head about the rotating shaft; and a pressing member that is provided to be rotatable about the rotating shaft together with the thermal head and presses the thermal head against the platen roller, in which the pressing member has a convex portion that protrudes toward the thermal head and presses the thermal head against the platen roller.

6 Claims, 12 Drawing Sheets

TAPE PRINTING DEVICE

The present application is based on, and claims priority from JP Application Serial Number 2020-165273, filed Sep. 30, 2020, the disclosure of which is hereby incorporated by reference herein in its entirety.

BACKGROUND

1. Technical Field

The present disclosure relates to a tape printing device provided with a thermal head.

2. Related Art

In the related art, as disclosed in JP-A-2002-166606, a tape printing device including a printing head and a head pressing member that rotatably holds the printing head about a fulcrum pin is known. The head pressing member presses the printing head against a platen via the fulcrum pin.

In the existing tape printing device, since the head pressing member presses the printing head with the fulcrum pin as a swing center, the printing head pressed by the fulcrum pin presses a tape with the platen as a support. As a result, when a width of the tape is large, the printing head may not be able to press the tape properly.

SUMMARY

A tape printing device according to the present disclosure includes a cartridge mounting portion in which a tape cartridge accommodating a tape and a platen roller is mounted, a platen shaft that engages with the platen roller, a thermal head that prints on the tape sandwiched with the platen roller engaged with the platen shaft, a head moving mechanism that moves the thermal head between a sandwiching position where the thermal head sandwiches the tape with the platen roller and a separating position where the thermal head is separated from the platen roller, a head holder that has a rotating shaft and that is configured to hold the thermal head to rotate about the rotating shaft so that the thermal head follows the platen roller after the thermal head is moved to the sandwiching position, and a pressing member that is provided and configured to rotate about the rotating shaft together with the thermal head and presses the thermal head against the platen roller after the thermal head is moved to the sandwiching position, in which the pressing member has a convex portion that protrudes toward the thermal head and that presses the thermal head against the platen roller.

DESCRIPTION OF EXEMPLARY EMBODIMENTS

Hereinafter, a tape printing device 1 which is an embodiment of a tape printing device will be described with reference to the accompanying drawings. In the following, the description will be made using the directions/axes according to the XYZ Cartesian coordinate system shown in each figure, but these directions/axes are for convenience of explanation only and do not limit the following embodiments in any way.

Tape Printing Device and Tape Cartridge

Figure 1:
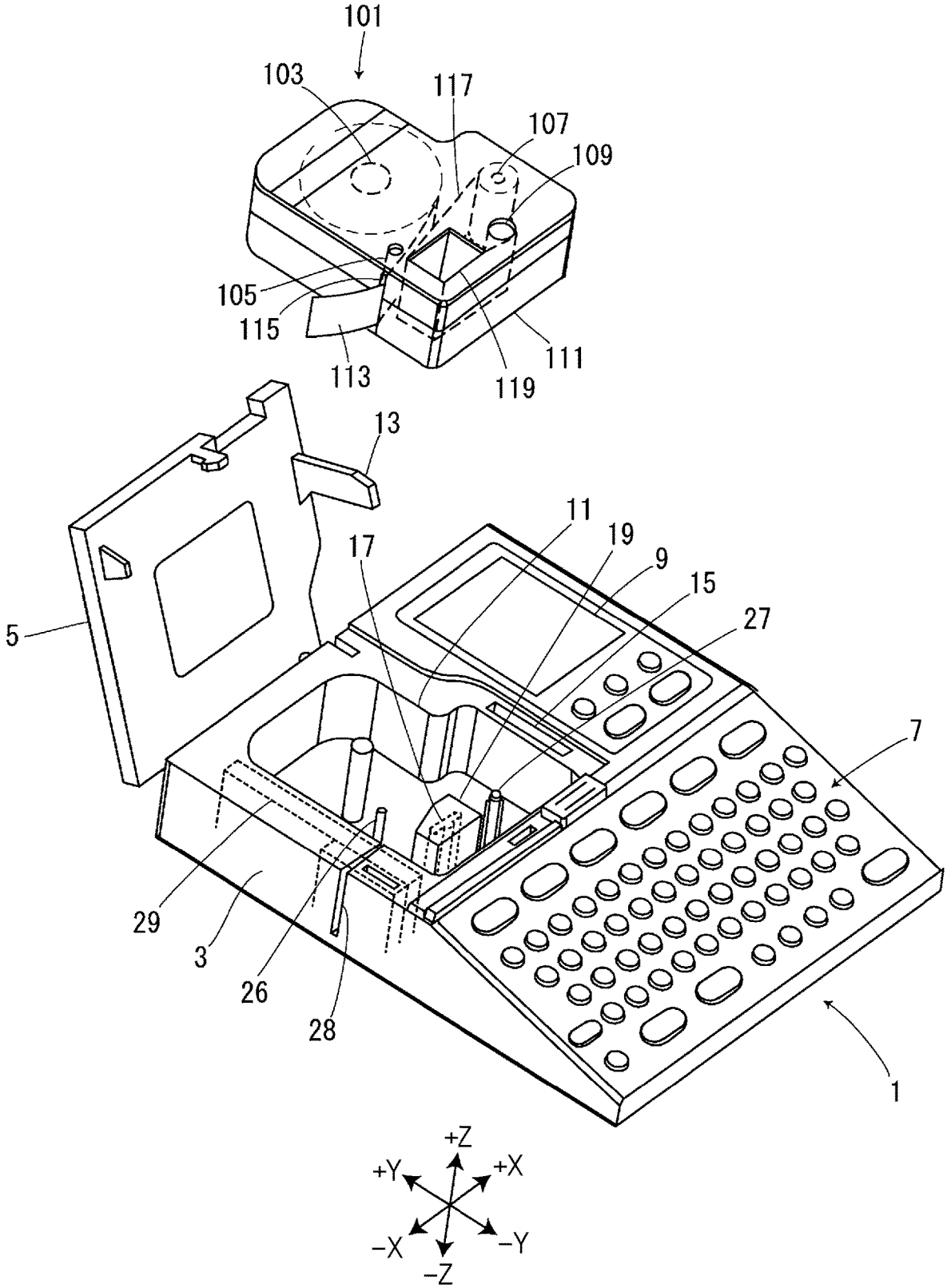
FIG. 1 is a perspective view of a tape printing device and a tape cartridge.
Figure 2:
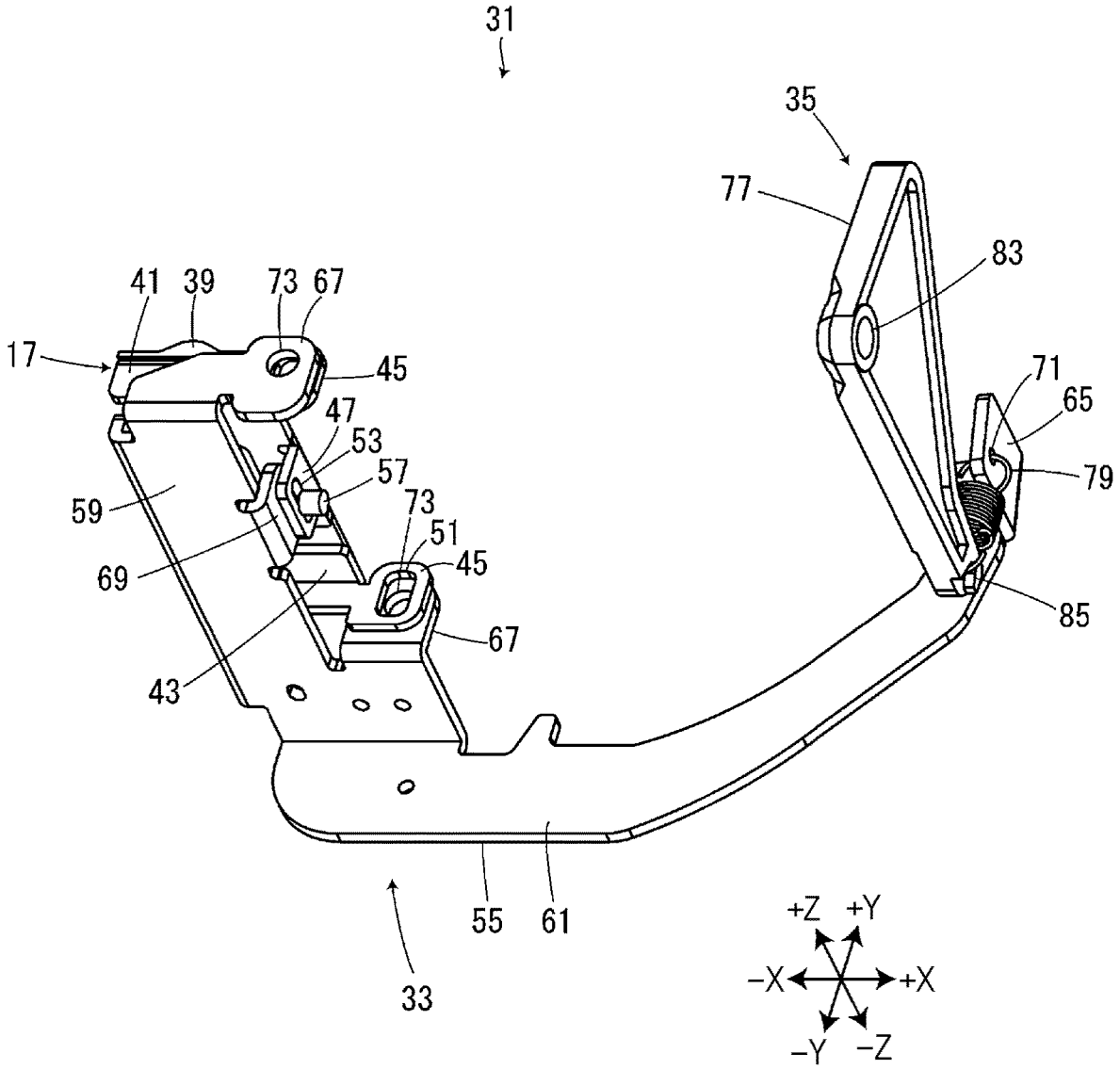
FIG. 2 is a perspective view of a printing portion.

The tape printing device 1 and a tape cartridge 101 that is detachably attached to the tape printing device 1 will be described with reference to FIG. 1. The tape cartridge 101 includes a tape core 103, a platen roller 105, a feeding core 107, a winding core 109, and a cartridge case 111 accommodating these. A tape 113 is wound around the tape core 103. The tape 113 fed from the tape core 103 is sent out of the cartridge case 111 from a tape outlet 115 provided in a wall portion in a −X direction of the cartridge case 111. An ink ribbon 117 is wound around the feeding core 107. The ink ribbon 117 fed from the feeding core 107 is wound around the winding core 109. The cartridge case 111 includes a head insertion hole 119 penetrating in a Z axis.

The tape printing device 1 includes a device case 3 and a mounting portion cover 5. A keyboard 7, a display 9, and a cartridge mounting portion 11 are provided at a surface of the device case 3 in a +Z direction.

The keyboard 7 receives an input operation by a user. The input operation includes, for example, an operation of inputting print information such as characters and symbols desired to be printed by the user, an operation of inputting various instructions such as printing execution, and the like. The tape printing device 1 is not limited to a configuration in which the print information, various instructions, and the like are acquired based on the input operation on the keyboard 7 and may be configured to acquire the print information and various instructions from an external device such as a personal computer or a smartphone.

The display 9 displays various types of information in addition to the print information input from the keyboard 7. The cartridge mounting portion 11 is formed in a concave shape that is opened in the +Z direction, and the tape cartridge 101 is detachably mounted therein.

The mounting portion cover 5 is rotatably attached to an end portion of the device case 3 in the +Y direction and opens and closes the cartridge mounting portion 11. A cover protrusion 13 located at an end portion in the +X direction is provided on an inner surface of the mounting portion cover 5. A protrusion entry opening 15 is provided in the +X direction of the cartridge mounting portion 11. The cover protrusion 13 enters the protrusion entry opening 15 when the mounting portion cover 5 is closed.

The cartridge mounting portion 11 is provided with a thermal head 17 and a head cover 19. As illustrated in FIG.

Figure 4:
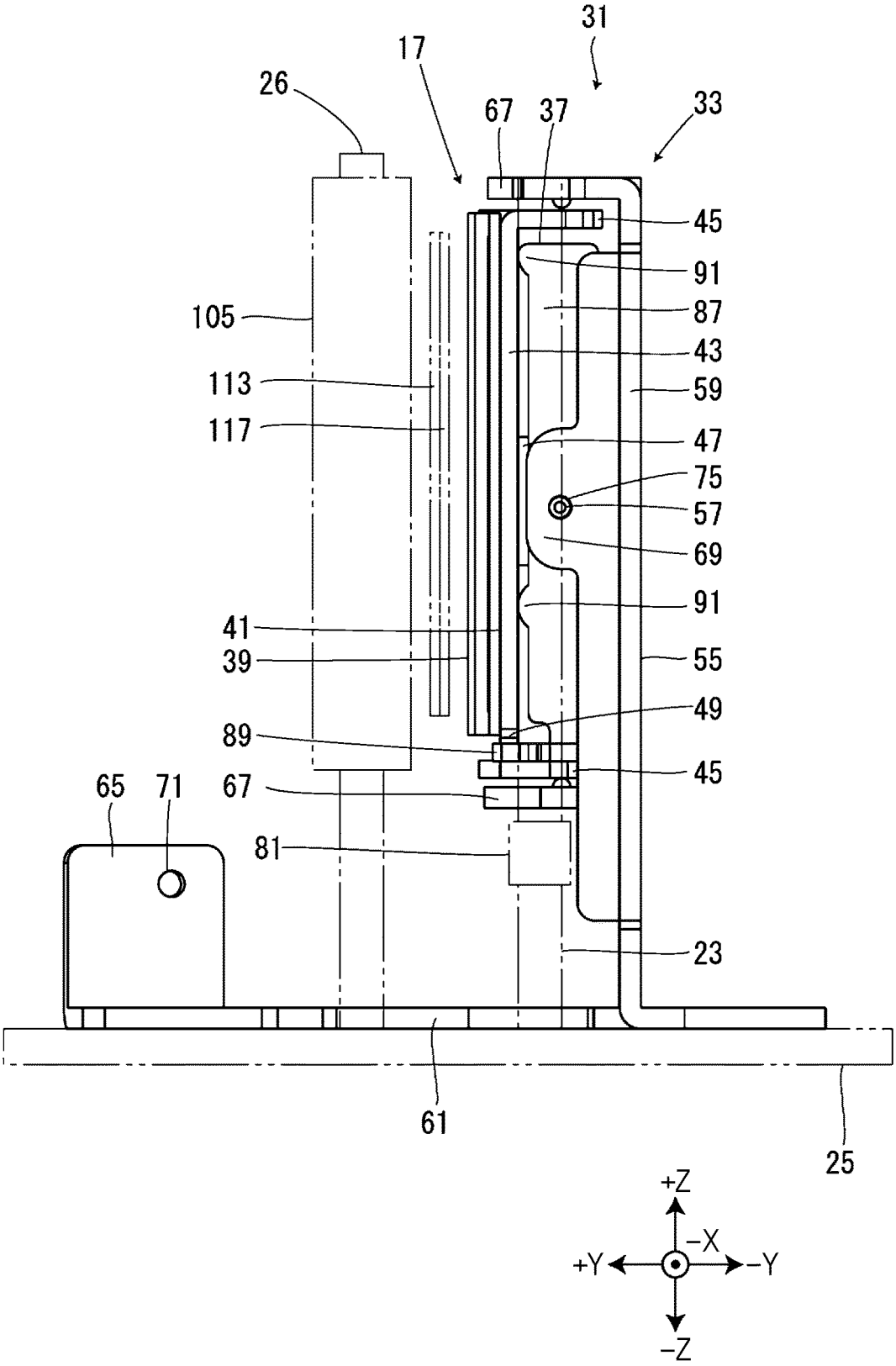
FIG. 4 is a view of the printing portion viewed from a −X direction.
Figure 5:
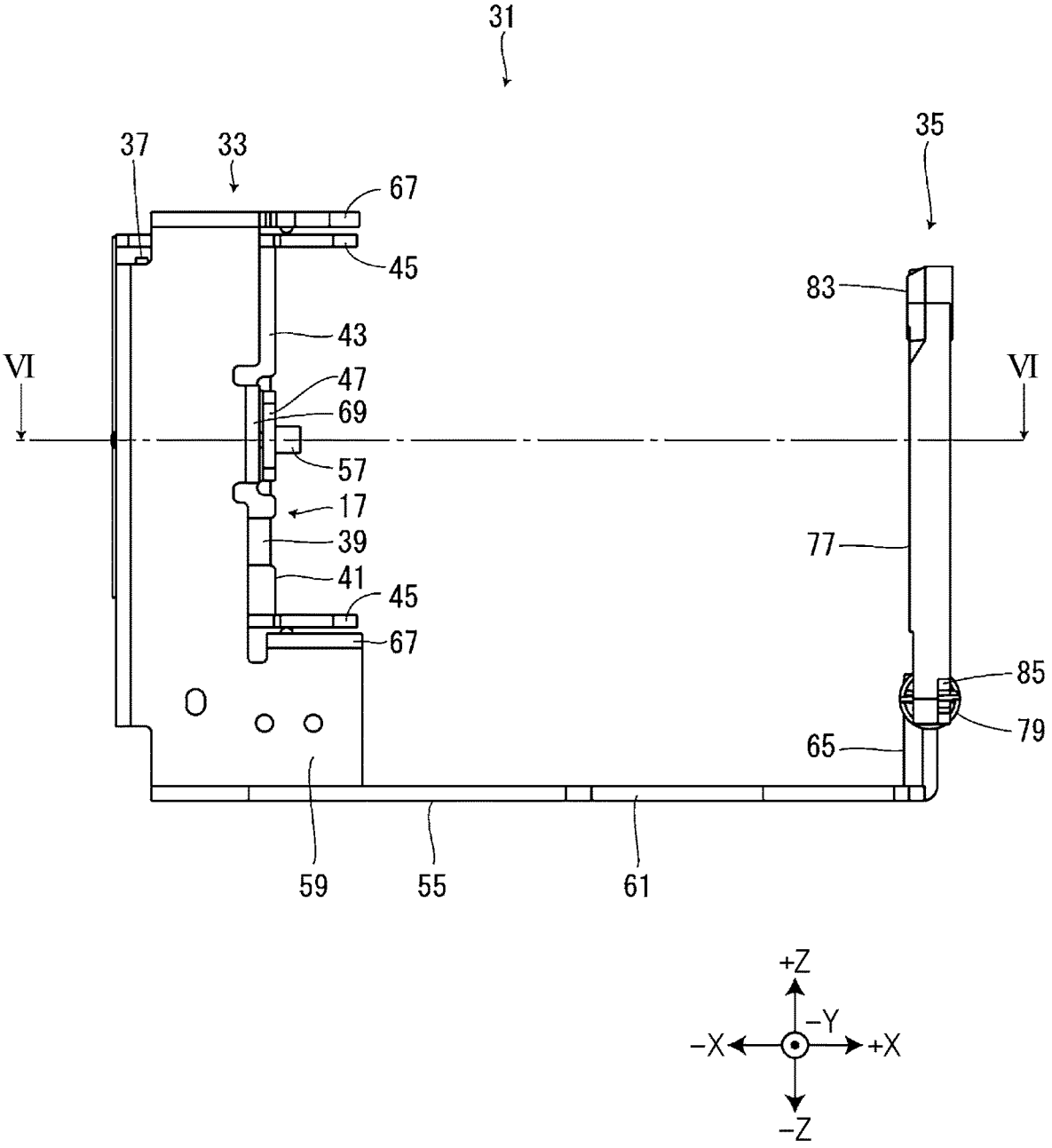
FIG. 5 is a view of the printing portion viewed from a −Y direction.

3, the thermal head 17 includes a heat generating element 21 and prints on the tape 113. The head cover 19 partially covers the thermal head 17. When the tape cartridge 101 is mounted in the cartridge mounting portion 11, the thermal head 17 and the head cover 19 are inserted into the head insertion hole 119. The thermal head 17 is supported by a head support shaft 23 illustrated in FIG. 4. As illustrated in FIG. 4, an end portion of the head support shaft 23 in the −Z direction is fixed to a base plate 25 built in the device case 3. That is, the head support shaft 23 has a cantilever structure and is supported only in the −Z direction.

Further, a platen shaft 26 and a winding shaft 27 protrude from a bottom surface of the cartridge mounting portion 11 in the +Z direction. The end portions of the platen shaft 26 and the winding shaft 27 in the −Z direction are fixed to the base plate 25. That is, the platen shaft 26 and the winding shaft 27 have a cantilever structure and are supported only in the −Z direction.

A tape discharge port 28 is provided in the surface of the device case 3 in the −X direction. The printed tape 113 is discharged from the tape discharge port 28. A cutter 29 is provided between the cartridge mounting portion 11 and the tape discharge port 28. The cutter 29 cuts the tape 113. As a result, a printed portion of the tape 113 is separated.

When the tape cartridge 101 is mounted in the cartridge mounting portion 11, the platen shaft 26 is inserted into the platen roller 105, and the platen roller 105 and the platen shaft 26 engage with each other. As a result, rotation of a motor (not illustrated) can be transmitted to the platen roller 105 via the platen shaft 26.

Similarly, when the tape cartridge 101 is mounted in the cartridge mounting portion 11, the winding shaft 27 is inserted into the winding core 109, and the winding core 109 and the winding shaft 27 engage with each other. As a result, the rotation of the motor can be transmitted to the winding core 109 via the winding shaft 27.

When the mounting portion cover 5 is closed after the tape cartridge 101 is mounted in the cartridge mounting portion 11, the thermal head 17 moves toward the platen roller 105 by a head moving mechanism 35 to be described later. As a result, the tape 113 and the ink ribbon 117 are sandwiched between the thermal head 17 and the platen roller 105. In this state, when a print execution instruction is input from the keyboard 7, the platen roller 105 and the winding core 109 rotate, and the tape 113 and the ink ribbon 117 are sent. At this time, the thermal head 17 generates heat, so that an image to be printed based on the print information input from the keyboard 7 is printed on the tape 113.

Printing Portion

A printing portion 31 will be described with reference to FIGS. 2 to 6. In FIG. 4, the platen shaft 26, the platen roller 105, the tape 113, the ink ribbon 117, the head support shaft 23, the base plate 25, and a head release spring 81 to be described later are virtually illustrated by a two-dot chain line. Further, in FIG. 4, for convenience of illustration, a head lever 77 and a head pressing spring 79, which will be described later, are omitted.

The printing portion 31 prints on the tape 113. In addition to the thermal head 17 described above, the printing portion 31 includes a head holder 33, the head moving mechanism 35, and a pressing member 37.

The thermal head 17 includes a head substrate 39 and a head heat dissipating plate 41.

The head substrate 39 is formed in a substantially rectangular plate shape elongated in the Z axis. The head substrate 39 includes a plurality of heat generating elements 21. The plurality of heat generating elements 21 are located at an end portion in the −X direction on a surface of the head substrate 39 in the +Y direction and are provided side by side in the Z axis. In a state in which the tape 113 and the ink ribbon 117 illustrated in FIG. 4 are sandwiched between the platen roller 105 engaged with the platen shaft 26 and the thermal head 17, when the heat generating elements 21 generate heat, ink of the ink ribbon 117 is transferred to the tape 113, and an image to be printed is printed on the tape 113.

The head heat dissipating plate 41 is engaged with the head substrate 39 and dissipates heat generated in the head substrate 39. The head heat dissipating plate 41 is made of a material having a high heat dissipation capacity such as a metal. The head heat dissipating plate 41 includes a heat dissipating main body portion 43, two heat dissipating side support shaft insertion portions 45, and two heat dissipating side rotating shaft insertion portions 47.

The heat dissipating main body portion 43 is formed in a substantially rectangular plate shape elongated in the Z axis. The head substrate 39 is provided on a surface of the heat dissipating main body portion 43 in the +Y direction. A Notch 49 notched in a substantially rectangular shape is provided at a corner of the heat dissipating main body portion 43 in the −X direction and the −Z direction.

The two heat dissipating side support shaft insertion portions 45 are provided at an end portion of the heat dissipating main body portion 43 in +Z direction and an end portion thereof in the −Z direction at an end portion of the heat dissipating main body portion 43 in the +X direction. Each heat dissipating side support shaft insertion portion 45 is provided with a heat dissipating side support shaft insertion hole 51. The head support shaft 23 is inserted through the two heat dissipating side support shaft insertion holes 51. The head heat dissipating plate 41 is rotatably supported by the head support shaft 23 about the head support shaft 23.

The two heat dissipating side rotating shaft insertion portions 47 protrude in the −Y direction from the vicinity of the end portion of the heat dissipating main body portion 43 in the +X direction and the end portion thereof in the −X direction in a substantially intermediate portion of the heat dissipating main body portion 43 in the Z axis. Each heat dissipating side rotating shaft insertion portion 47 is provided with a heat dissipating side rotating shaft insertion hole 53. A rotating shaft 57, which will be described later, is inserted into the two heat dissipating side rotating shaft insertion holes 53. The head heat dissipating plate 41 is configured to be rotatable at a minute angle about the rotating shaft 57. There is a gap between each heat dissipating side support shaft insertion hole 51 and the head support shaft 23 to such an extent that the head heat dissipating plate 41 can rotate at a minute angle about the rotating shaft 57.

The head holder 33 holds the thermal head 17 and the pressing member 37. The head holder 33 includes a holder main body 55 and the rotating shaft 57.

The holder main body 55 holds the thermal head 17 and the pressing member 37 via the rotating shaft 57. The holder main body 55 includes a first holder portion 59, a second holder portion 61, a holder side spring engaging portion 65, two holder side support shaft insertion portions 67, and two holder side rotating shaft insertion portions 69.

The first holder portion 59 is a plate-like member formed in a substantially "L" shape. The second holder portion 61 is provided so as to extend in the +X direction from an end portion of the first holder portion 59 in the −Z direction and to be curved in the +Y direction. At an end portion of the second holder portion 61 in the +X direction and the +Y direction, the holder side spring engaging portion 65 is provided so as to protrude in the +Z direction. The holder side spring engaging portion 65 includes a holder side spring engaging hole 71. An end portion of the head pressing spring 79 in the +Y direction is engaged with the holder side spring engaging hole 71.

The two holder side support shaft insertion portions 67 are provided at an end portion of the first holder portion 59 in the +Z direction and an end portion thereof in the −Z direction at an end portion of the first holder portion 59 in the +X direction. The two holder side support shaft insertion portions 67 are located outside the two heat dissipating side support shaft insertion portions 45. Each holder side support shaft insertion portion 67 includes a holder side support shaft insertion hole 73. The head support shaft 23 is inserted through the two holder side support shaft insertion holes 73. The head holder 33 is rotatably supported by the head support shaft 23 about the head support shaft 23.

The two holder side rotating shaft insertion portions 69 protrude in the +Y direction from an end portion of the first holder portion 59 in the +X direction and an end portion of thereof in the −X direction in a substantially intermediate portion of the first holder portion 59 in the Z axis. The holder side rotating shaft insertion portion 69 in the +X direction is provided in the −X direction with respect to the heat dissipating side rotating shaft insertion portion 47 in the +X direction, and the holder side rotating shaft insertion portion 69 in the −X direction is provided in the −X direction with respect to the heat dissipating side rotating shaft insertion portion 47 in the −X direction (see FIG. 6). Each holder side rotating shaft insertion portion 69 includes a holder side rotating shaft insertion hole 75. The rotating shaft 57 is inserted through the two holder side rotating shaft insertion holes 75.

The rotating shaft 57 extends in the X axis and penetrates through the two heat dissipating side rotating shaft insertion holes 53, the two holder side rotating shaft insertion holes 75, and a pressing side rotating shaft insertion hole 93, which will be described later. The rotating shaft 57 is fixed to the holder side rotating shaft insertion portion 69 in the −X direction and rotatably supports the head heat dissipating plate 41 and the pressing member 37.

The head moving mechanism 35 moves the thermal head 17 between a sandwiching position and a separating position in conjunction with an opening/closing operation of the mounting portion cover 5. That is, the head moving mechanism 35 moves the thermal head 17 to the sandwiching position when the mounting portion cover 5 is closed and moves the thermal head 17 to the separating position when the mounting portion cover 5 is opened. The sandwiching position means a position where the thermal head 17 sandwiches the tape 113 and the ink ribbon 117 with the platen roller 105. The separating position means a position where the thermal head 17 is separated from the platen roller 105.

The head moving mechanism 35 includes the head lever 77, the head pressing spring 79, and the head release spring 81.

The head lever 77 converts the opening/closing operation of the mounting portion cover 5 into a rotational operation of the head holder 33. The head lever 77 is formed in a substantially triangular plate shape. The head lever 77 includes a lever support shaft engaging portion 83 and a lever side spring engaging portion 85. The lever support shaft engaging portion 83 is provided at an end portion of the head lever 77 in the −Y direction and the +Z direction. A lever support shaft (not illustrated) extending in the X axis is engaged with the lever support shaft engaging portion 83. The head lever 77 is rotatably supported by the lever support shaft. The lever side spring engaging portion 85 is provided at an end portion of the head lever 77 in the −Z direction. An end portion of the head pressing spring 79 in the −Y direction is engaged with the lever side spring engaging portion 85.

The head pressing spring 79 applies a force to the head holder 33 so that the thermal head 17 held by the head holder 33 is pressed against the platen roller 105 engaged with the platen shaft 26. The head pressing spring 79 is provided between the head lever 77 and the head holder 33. As the head pressing spring 79, for example, a tension coil spring can be used.

As illustrated in FIG. 4, the head release spring 81 is provided around the head support shaft 23 and applies a force to the head holder 33 in a direction in which the head holder 33 rotates counterclockwise about the head support shaft 23 when viewed from the +Z direction. Therefore, the thermal head 17 is located at the separating position when the mounting portion cover 5 is opened. As the head release spring 81, for example, a torsion coil spring can be used.

When the mounting portion cover 5 is closed, the cover protrusion 13 that has entered through the protrusion entry opening 15 hits a surface of the head lever 77 in the +Z direction. As a result, the head lever 77 rotates clockwise about the lever support shaft when viewed from the +X direction, so that the head pressing spring 79 extends. Therefore, the holder side spring engaging portion 65 of the head holder 33 is pulled in the −Y direction via the head pressing spring 79. As a result, the head holder 33 rotates clockwise about the head support shaft 23 when viewed from the +Z direction against the head release spring 81. As a result, the thermal head 17 held by the head holder 33 moves to the sandwiching position. The thermal head 17 is pressed against the platen roller 105 by an elastic force of the extended head pressing spring 79.

At this time, even if an axial direction of the platen roller 105 engaged with the platen shaft 26 is tilted with respect to an axial direction of the platen shaft 26, since the head heat dissipating plate 41 can rotate about the rotating shaft 57 as described above, the thermal head 17 rotates about the rotating shaft 57 so that the thermal head 17 follows the platen roller 105. Thereby, a pressing force of the thermal head 17 to the tape 113 can be made uniform in the axial direction of the platen roller 105, that is, the width direction of the tape 113. Therefore, a print density of the printed image can be made uniform in the width direction of the tape 113, and an occurrence of printing defects such as blurring in the printed image can be suppressed. The thermal head 17 following the platen roller 105 means that the thermal head 17 is tilted so that the extending direction of the plurality of heat generating elements 21 provided at the thermal head 17 is parallel to the axial direction of the platen roller 105.

After the thermal head 17 is moved to the sandwiching position, the pressing member 37 presses the thermal head 17 against the platen roller 105. The pressing member 37 includes a first pressing portion 87, a second pressing portion 89, and two convex portions 91.

The first pressing portion 87 is formed in a substantially rectangular plate shape elongated in the Z axis. The first pressing portion 87 is located between the heat dissipating main body portion 43 of the head heat dissipating plate 41 and the first holder portion 59 of the head holder 33 in the Y axis. Further, the first pressing portion 87 is located in the X axis between the heat dissipating side rotating shaft insertion portion 47 of the head heat dissipating plate 41 in the −X direction and the holder side rotating shaft insertion portion 69 of the head holder 33 in the −X direction. The first pressing portion 87 includes the pressing side rotating shaft insertion hole 93 in a substantially intermediate portion thereof in the Z axis. The rotating shaft 57 is inserted through the pressing side rotating shaft insertion hole 93. That is, the pressing member 37 is rotatably supported by the rotating shaft 57 about the rotating shaft 57.

The second pressing portion 89 is provided so as to be bent in the +X direction from the end portion of the first pressing portion 87 in the −Z direction and protrudes in the +Y direction. The second pressing portion 89 has a predetermined gap from an end surface of the head heat dissipating plate 41 in the −Z direction, that is, an edge portion of the notch portion 49 provided in the heat dissipating main body portion 43 of the head heat dissipating plate 41. By mounting the surface of the second pressing portion 89 on the −Z side on a flat surface such as a work table when assembling the pressing member 37 and the thermal head 17, an assembling property between the pressing member 37 and the thermal head 17 can be improved. Further, by providing the second pressing portion 89, a heat capacity of the pressing member 37 increases, and a contact area between the pressing member 37 and the atmosphere increases. Therefore, since the dissipation capacity of the heat transferred from the head heat dissipating plate 41 to the pressing member 37 via the two convex portions 91 is improved, the heat dissipation capacity of the thermal head 17 can be improved.

Figure 3:
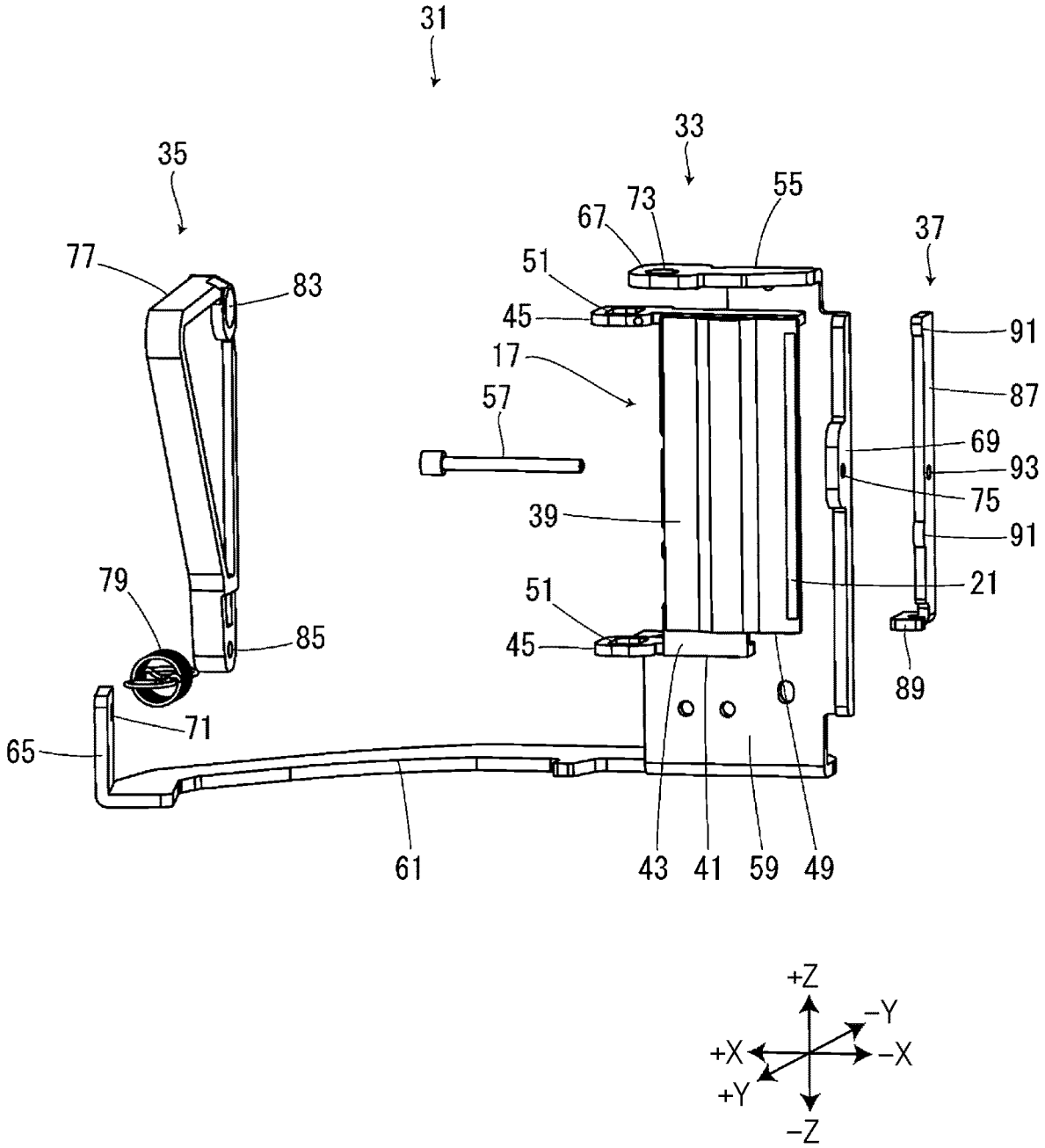
FIG. 3 is an exploded perspective view of the printing portion.

The two convex portions 91 are portions for pressing the thermal head 17 against the platen roller 105 after the thermal head 17 is moved to the sandwiching position. The two convex portions 91 are provided on a surface of the first pressing portion 87 in the +Y direction and protrude in the +Y direction, that is, toward the head heat dissipating plate 41 in a substantially hemispherical shape. As illustrated in FIGS. 3 and 4, one of the two convex portions 91 is provided at the end portion of the first pressing portion 87 in the +Z direction, and the other of the two convex portions 91 is provided at a substantially intermediate portion between the pressing side rotating shaft insertion hole 93 and the end portion of the first pressing portion 87 in the −Z direction. That is, one of the two convex portions 91 is provided in the +Z direction with respect to the rotating shaft 57, and the other of the two convex portions 91 is provided in the −Z direction with respect to the rotating shaft 57.

Here, when the thermal head 17 is moved to the sandwiching position and hits the platen roller 105, the thermal head 17 rotates about the rotating shaft 57 so as to follow the platen roller 105 as described above. At this time, the pressing member 37 is in contact with the head heat dissipating plate 41 at the two convex portions 91. As a result, the pressing member 37 is pushed by the thermal head 17 and rotates about the rotating shaft 57 together with the thermal head 17. Further, the rotating shaft 57 fixed to the holder main body 55 presses the pressing member 37 supported by the rotating shaft 57 against the platen roller 105. Therefore, the two convex portions 91 included in the pressing member 37 press the thermal head 17 against the platen roller 105. As a result, the thermal head 17 pressed by the two convex portions 91 presses the tape 113 with the platen roller 105 as a support.

Here, unlike the present embodiment, if the printing portion 31 does not include the pressing member 37 and the thermal head 17 is directly pushed by the rotating shaft 57, printing defects such as blurring in the printed image may occur at the end portion of the tape 113 in the +Z direction. This is because the pressing force of the thermal head 17 to the tape 113 is made uniform in the width direction of the tape 113 by the thermal head 17 rotating about the rotating shaft 57 so as to follow the platen roller 105 as described above, but the platen shaft 26 and the head support shaft 23 have the cantilever structure in which only the −Z direction is supported, so that the pressing force of the thermal head 17 to the tape 113 tends to be small in the +Z direction.

On the other hand, in the present embodiment, since the thermal head 17 is pressed by the convex portion 91 provided in the +Z direction with respect to the rotating shaft 57 and the convex portion 91 provided in the −Z direction with respect to the rotating shaft 57, the thermal head 17 can press the tape 113 in a well-balanced manner in the direction in which the two convex portions 91 are arranged, that is, in the width direction of the tape 113. Therefore, it is possible to suppress printing defects such as blurring from occurring in the printed image printed on the tape 113.

Figure 6:
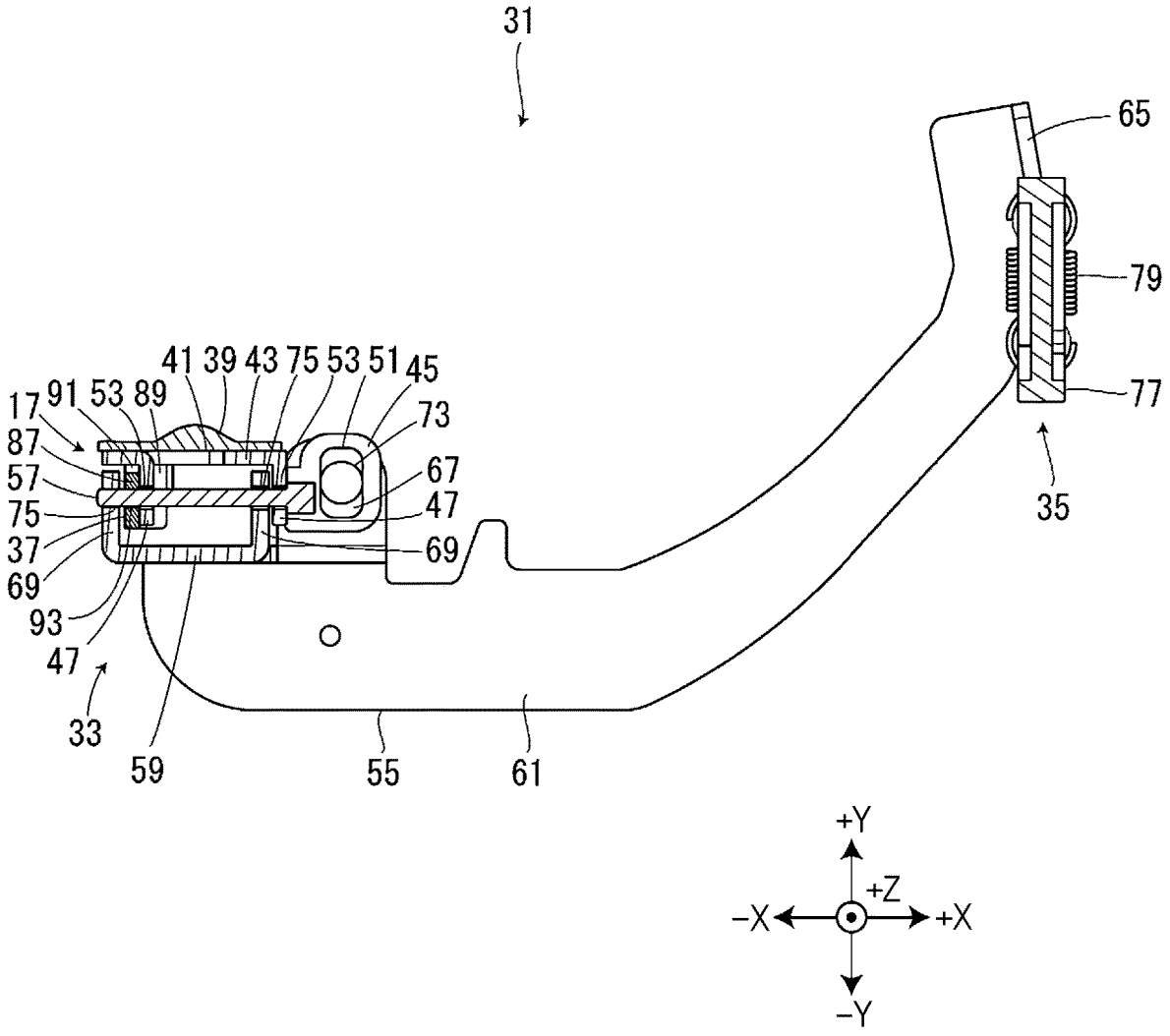
FIG. 6 is a sectional view of the printing portion taken along a cutting line VI-VI of FIG. 5.

As illustrated in FIG. 6, while the rotating shaft 57 and the pressing side rotating shaft insertion hole 93 are in contact with each other, a gap is formed between the rotating shaft 57 and the heat dissipating side rotating shaft insertion hole 53. Therefore, the rotating shaft 57 presses the pressing member 37 against the platen roller 105 but does not directly press the head heat dissipating plate 41 against the platen roller 105. That is, the rotating shaft 57 presses the head heat dissipating plate 41 via the pressing member 37.

Further, when the thermal head 17 moves to the separating position, that is, when the holder main body 55 rotates counterclockwise when viewed from the +Z direction, the rotating shaft 57 and the pressing member 37 supported by the rotating shaft 57 move in the −Y direction with respect to the head heat dissipating plate 41 by the gap between the rotating shaft 57 and the heat dissipating side rotating shaft insertion hole 53. Therefore, after the thermal head 17 is moved to the separating position, the two convex portions 91 are separated from the head heat dissipating plate 41. That is, the two convex portions 91 are in contact with the head heat dissipating plate 41 only after the thermal head 17 is moved to the sandwiching position.

As described above, according to the present embodiment, after the thermal head 17 is moved to the sandwiching position, the thermal head 17 and the pressing member 37 rotate together about the rotating shaft 57 so that the thermal head 17 follows the platen roller 105, and the thermal head 17 pressed by the convex portion 91 provided separately from the rotating shaft 57 presses the tape 113 with the platen roller 105 as a support. Therefore, by arranging the convex portion 91 at a desired position, the thermal head 17 can appropriately press the tape 113. As a result, it is possible to suppress printing defects such as blurring from occurring in the printed image printed on the tape 113.

Other Modification of Embodiment

The present disclosure is not limited to the above embodiment, and various configurations can be adopted without departing from the spirit of the present disclosure. For example, the above embodiment can be changed to the following form in addition to those described above. Further, the configuration may be a combination of embodiments and modification thereof.

Figure 7:
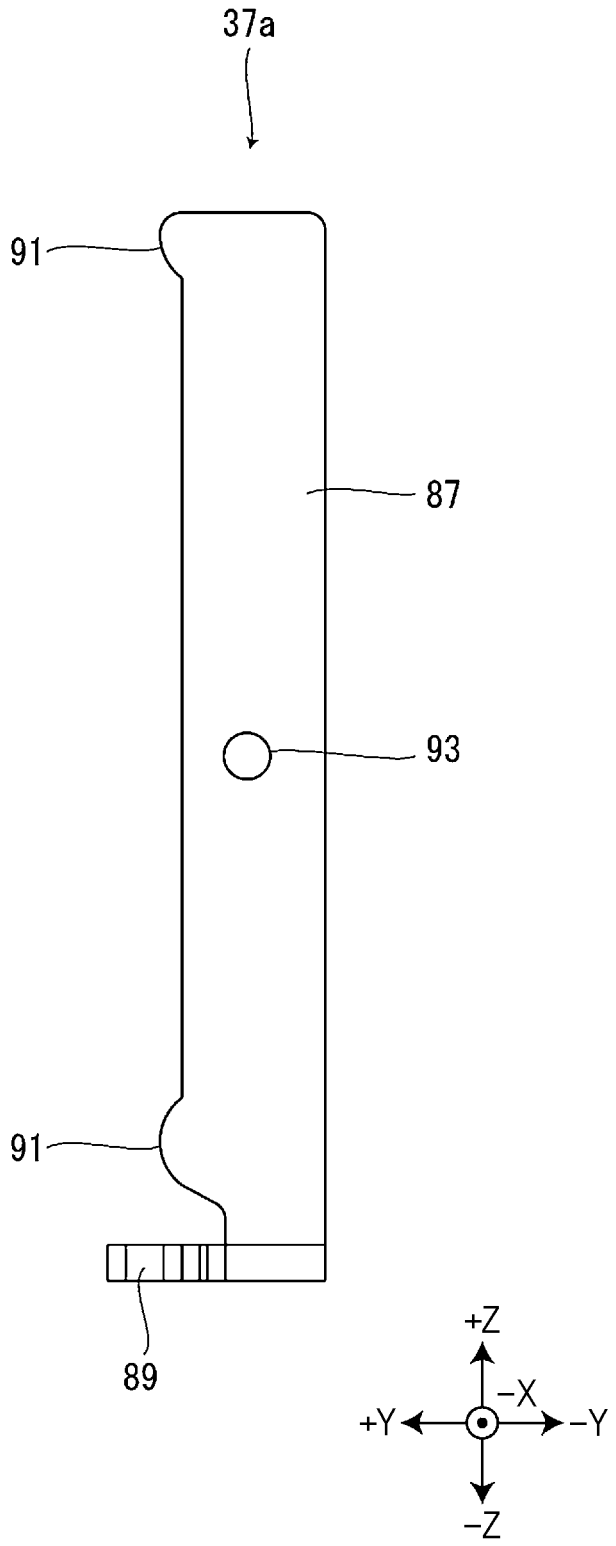
FIG. 7 is a view of a pressing member of a first modification viewed from the −X direction.
Figure 8:
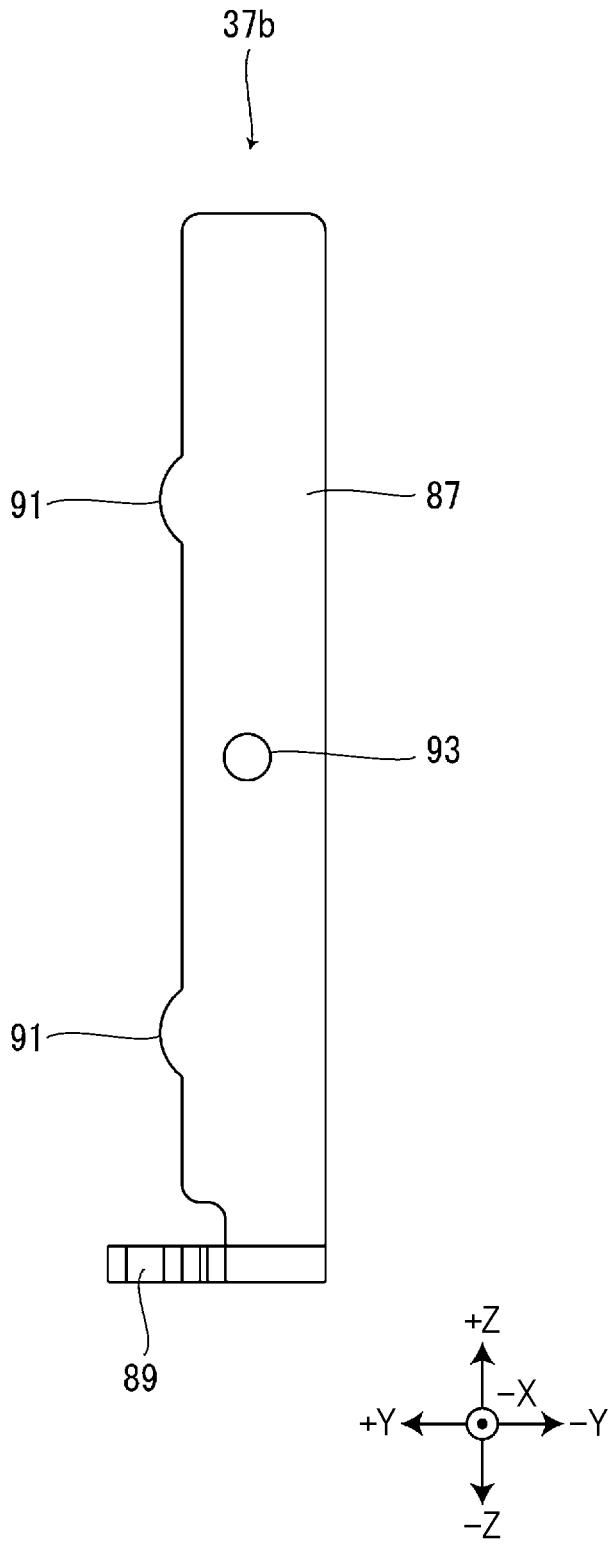
FIG. 8 is a view of a pressing member of a second modification viewed from the −X direction.
Figure 9:
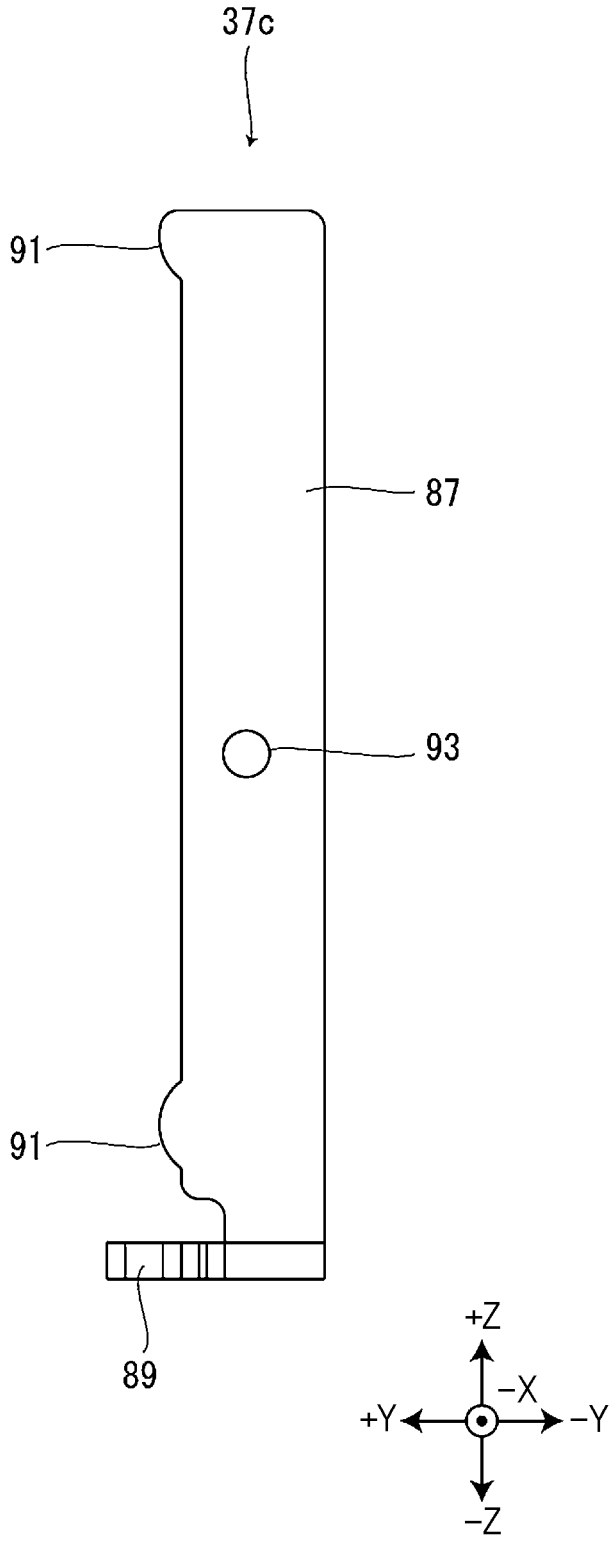
FIG. 9 is a view of a pressing member of a third modification viewed from the −X direction.
Figure 10:
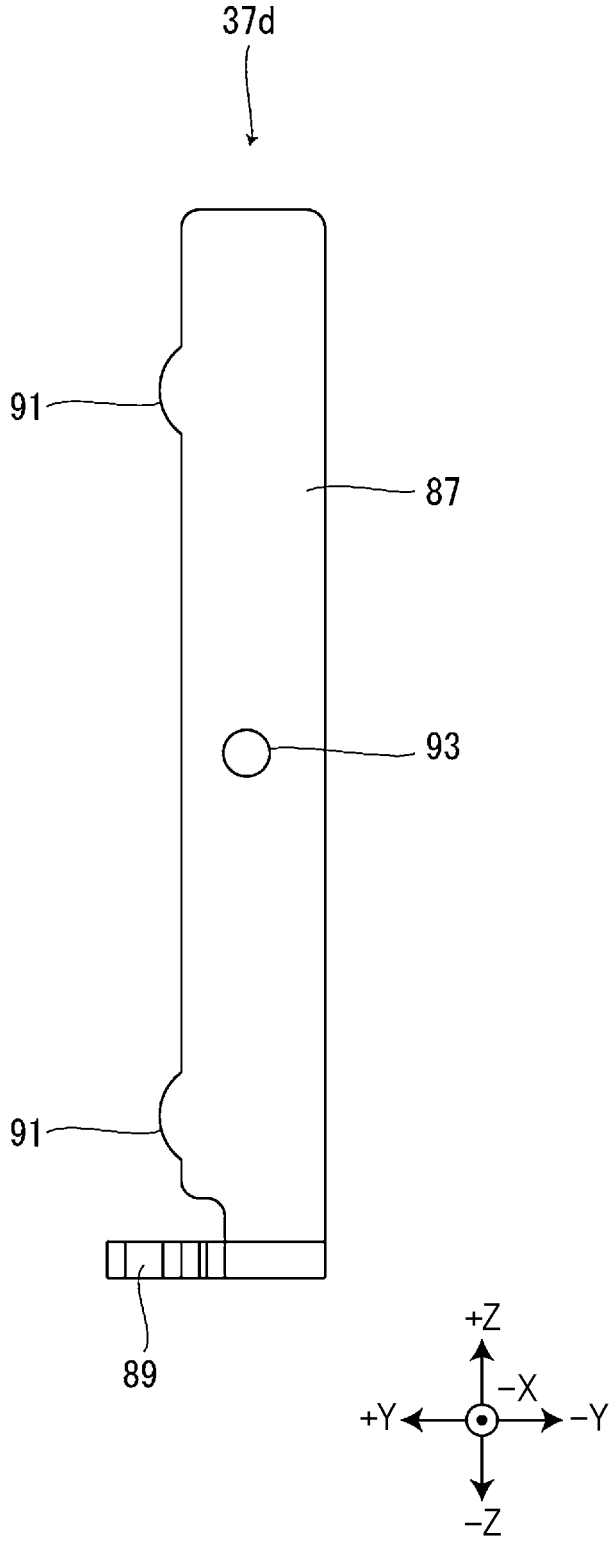
FIG. 10 is a view of a pressing member of a fourth modification viewed from the −X direction.

The pressing member 37 includes the two convex portions 91 provided at different positions in the axial direction of the platen shaft 26, but the position where the two convex portions 91 are provided is not limited to the positions illustrated in FIGS. 3 and 4. For example, as in a pressing member 37*a* of a first modification illustrated in FIG. 7, one convex portion 91 may be provided at the end portion of the first pressing portion 87 in the +Z direction, and the other convex portion 91 may be provided at the end portion of the first pressing portion 87 in the −Z direction. As in a pressing member 37*b* of a second modification illustrated in FIG. 8, one convex portion 91 may be provided at a substantially intermediate portion between the pressing side rotating shaft insertion hole 93 and the end portion of the first pressing portion 87 in the +Z direction, and the other convex portion 91 may be provided at a substantially intermediate portion between the pressing side rotating shaft insertion hole 93 and the end portion of the first pressing portion 87 in the −Z direction. As in a pressing member 37*c* of a third modification illustrated in FIG. 9, one convex portion 91 may be provided at the end portion of the first pressing portion 87 in the +Z direction and the other convex portion 91 may be provided in the vicinity of the end portion of the first pressing portion 87 in the −Z direction. As in a pressing member 37*d* of a fourth modification illustrated in FIG. 10, one convex portion 91 may be provided at a substantially intermediate portion between the pressing side rotating shaft insertion hole 93 and the end portion of the first pressing portion 87 in the +Z direction, and the other convex portion 91 may be provided in the vicinity of the end portion of the first pressing portion 87 in the −Z direction. Further, although not illustrated, both of the two convex portions 91 may be provided in the +Z direction with respect to the pressing side rotating shaft insertion hole 93 and may be provided in the −Z direction with respect to the pressing side rotating shaft insertion hole 93. Further, although not illustrated, one of the two convex portions 91 may be provided at the same position as the pressing side rotating shaft insertion hole 93 in the Z axis.

As described above, since the pressing member 37 includes the two convex portions 91 provided at different positions in the axial direction of the platen shaft 26, the thermal head 17 pressed by the two convex portions 91 presses the tape 113 with the platen roller 105 as a support. Therefore, even when the thermal head 17 prints on a tape 113 having a large width, for example, a width of 36 mm, the pressing force of the thermal head 17 to the tape 113 can be made uniform in the direction in which the two convex portions 91 are arranged, that is, in the width direction of the tape 113.

Figure 11:
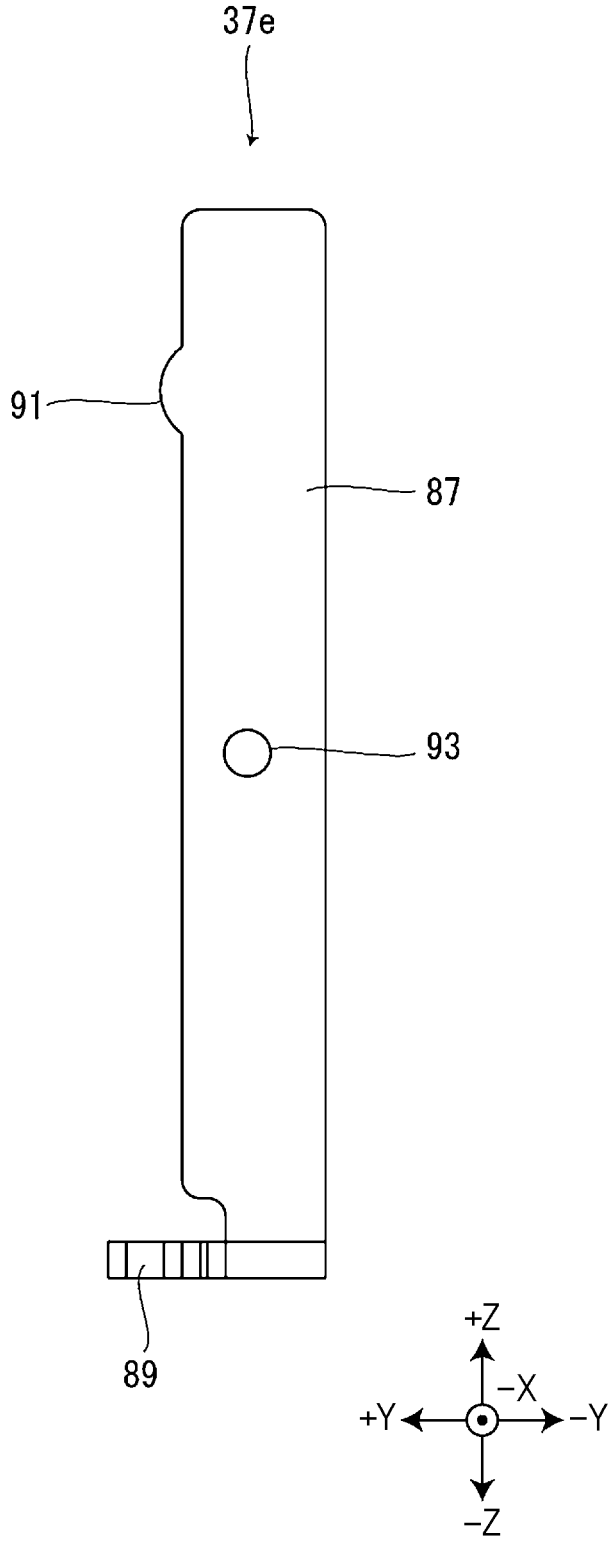
FIG. 11 is a view of a pressing member of a fifth modification viewed from the −X direction.
Figure 12:
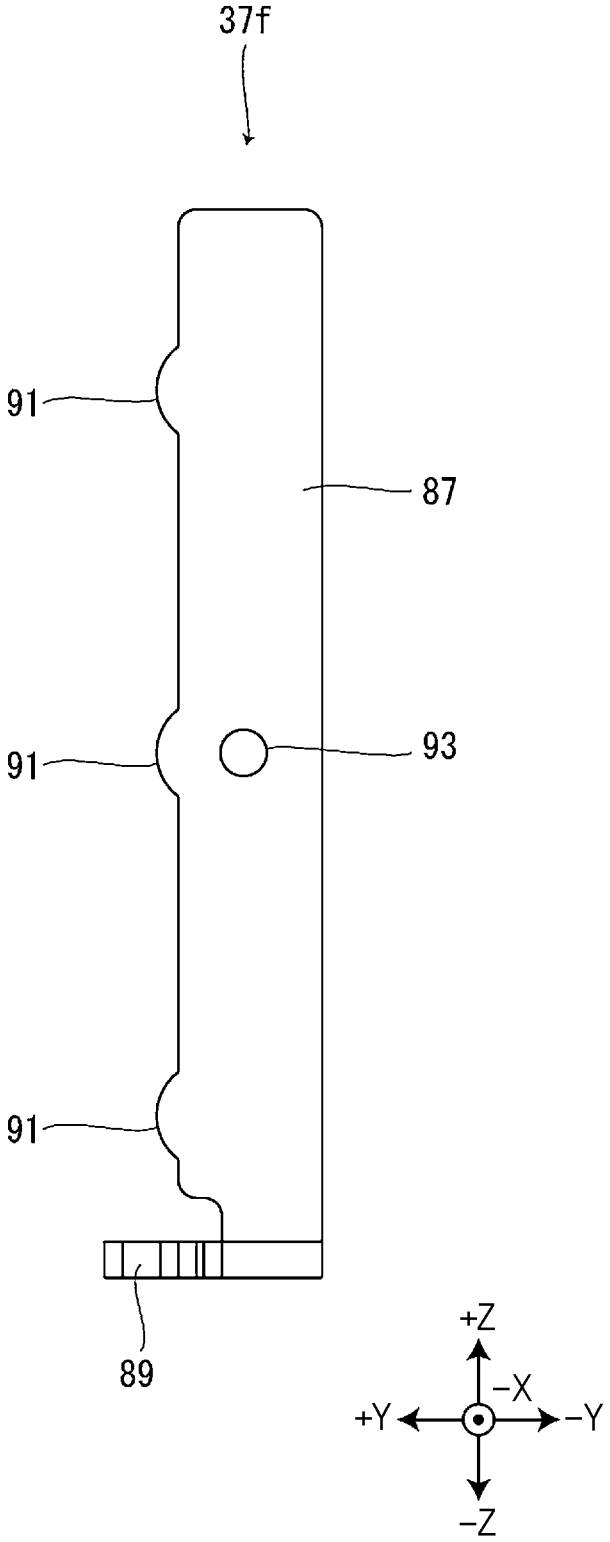
FIG. 12 is a view of a pressing member of a sixth modification viewed from the −X direction.

The pressing member 37 is not limited to the configuration including two convex portions 91 provided at different positions in the axial direction of the platen shaft 26. For example, as in the pressing member 37*e* of a fifth modification illustrated in FIG. 11, a configuration having one convex portion 91 may be provided. Further, as in a pressing member 37*f* of a sixth modification illustrated in FIG. 12, at least three convex portions 91 may be provided at different positions in the axial direction of the platen shaft 26. According to such a configuration, the thermal head 17 pressed by at least three convex portions 91 presses the tape 113 with the platen roller 105 as a support. Therefore, when a plurality of types of tapes 113 having different widths are present, any of the tapes 113 can be appropriately pressed by the thermal head 17. Even in the configuration in which the pressing member 37 has one convex portion 91 or the configuration in which the pressing member 37 has at least three convex portions 91, similarly to the configuration in which the pressing member 37 includes the two convex portions 91, the position where the convex portion 91 is provided is not particularly limited.

A plurality of types of pressing members 37 having different positions or numbers of convex portions 91 may be prepared so that the user can replace the pressing member 37 with a desired pressing member 37. For example, when the tape cartridge 101 accommodating the tape 113 having a small width, for example, a width of 9 mm, is mounted in the cartridge mounting portion 11, the user replaces the pressing member 37 with a pressing member 37 having one convex portion 91. Further, when the tape cartridge 101 accommodating the tape 113 having a large width, for example, a width of 36 mm, is mounted in the cartridge mounting portion 11, the user replaces the pressing member 37 with a pressing member 37 having two or three convex portions 91.

The tape printing device 1 may be configured to include a plurality of types of pressing members 37 having different positions or numbers of convex portions 91 and to allow switching of the pressing member 37 according to the width of the tape 113 accommodated in the tape cartridge 101 mounted in the cartridge mounting portion 11. The tape printing device 1 may acquire the width of the tape 113 accommodated in the tape cartridge 101 mounted in the cartridge mounting portion 11, for example, by a sensor provided with the cartridge mounting portion 11 or based on information input from the keyboard 7 or the like.

The tape printing device 1 may be configured to include a pressing member 37 provided with a plurality of convex portions 91 capable of individually advancing and retreating and to allow selection of the position or number of the convex portions 91 that press the thermal head 17 by advancing and retreating each convex portion 91 according to the width of the tape 113 accommodated in the tape cartridge 101 mounted in the cartridge mounting portion 11.

Appendix

Hereinafter, the tape printing device will be additionally described.

The tape printing device includes a cartridge mounting portion in which a tape cartridge accommodating a tape and a platen roller is mounted, a platen shaft that engages with the platen roller, a thermal head that prints on the tape sandwiched with the platen roller engaged with the platen shaft, a head moving mechanism that moves the thermal head between a sandwiching position where the thermal head sandwiches the tape with the platen roller and a separating position where the thermal head is separated from the platen roller, a head holder that has a rotating shaft and that is configured to hold the thermal head to rotate about the rotating shaft so that the thermal head follows the platen roller after the thermal head is moved to the sandwiching position, and a pressing member that is provided and configured to rotate about the rotating shaft together with the thermal head and that presses the thermal head against the platen roller after the thermal head is moved to the sandwiching position, in which the pressing member has a convex portion that protrudes toward the thermal head and that presses the thermal head against the platen roller.

According to such a configuration, after the thermal head is moved to the sandwiching position, the thermal head and the pressing member rotate together about the rotating shaft so that the thermal head follows the platen roller and the thermal head pressed by the convex portion provided separately from the rotating shaft presses the tape with the platen roller as a support. Therefore, by arranging the convex portion at a desired position, the thermal head can appropriately press the tape.

In this case, the pressing member preferably has two convex portions provided at different positions in an axial direction of the platen shaft.

According to such a configuration, the thermal head pressed by the two convex portions provided at different positions in the axial direction of the platen shaft presses the tape with the platen roller as a support. Therefore, even when the thermal head prints on a tape having a large width, a pressing force of the thermal head to the tape can be made uniform in a direction in which the two convex portions are arranged, that is, in a width direction of the tape.

In this case, the pressing member preferably has at least three convex portions provided at different positions in the axial direction of the platen shaft.

According to such a configuration, the thermal head pressed by at least three convex portions provided at different positions in the axial direction of the platen shaft presses the tape with the platen roller as a support. Therefore, any of tapes having different widths can be appropriately pressed by the thermal head.

In this case, the pressing member preferably has a plurality of convex portions provided at different positions in the axial direction of the platen shaft, and it is preferable that at least one of the plurality of convex portions is provided in a first direction, which is one of the axial directions of the platen shaft, with respect to the rotating shaft, and at least another one of the plurality of convex portions is provided in a second direction opposite to the first direction with respect to the rotating shaft.

According to such a configuration, the thermal head pressed by the convex portion provided in the first direction with respect to the rotating shaft and the convex portion provided in the second direction with respect to the rotating shaft presses the tape with the platen roller as a support. Therefore, the thermal head can press the tape in a well-balanced manner in the direction in which the two convex portions are arranged, that is, in the width direction of the tape.

The +Z direction is an example of the "first direction", and the −Z direction is an example of the "second direction".

In this case, the pressing member preferably has a first pressing portion provided with the convex portion and a second pressing portion provided by bending at an end portion of the first pressing portion.

According to such a configuration, by mounting a surface of the second pressing portion on the −Z side on a flat surface such as a work table when assembling the pressing member and the thermal head, an assembling property between the pressing member and the thermal head can be improved. Further, by providing the second pressing portion, a heat capacity of the pressing member increases and a contact area between the pressing member and the atmosphere increases. Therefore, the dissipation capacity of the heat transferred from the thermal head to the pressing member via the convex portion is improved, so that the heat dissipation capacity of the thermal head can be improved.

In this case, the convex portion is preferably separated from the thermal head after the thermal head is moved to the separating position.

According to such a configuration, the convex portion comes into contact with the thermal head only after the thermal head is moved to the sandwiching position.

What is claimed is:

1. A tape printing device comprising:

a cartridge mounting portion in which are mounted a tape cartridge accommodating a tape and a platen roller;

a platen shaft that engages with the platen roller;

a thermal head that prints on the tape sandwiched between the thermal head and the platen roller engaged with the platen shaft;

a head support shaft that supports the thermal head;

a head moving mechanism that moves the thermal head between (i) a sandwiching position where the thermal head sandwiches the tape with the platen roller and (ii) a separating position where the thermal head is separated from the platen roller;

a head holder that has a rotating shaft and that is configured to hold the thermal head to rotate about the rotating shaft so that the thermal head follows the platen roller after the thermal head is moved to the sandwiching position; and a pressing member that is provided and configured to rotate about the rotating shaft together with the thermal head and that presses the thermal head against the platen roller after the thermal head is moved to the sandwiching position, wherein the pressing member has a convex portion that protrudes toward the thermal head and that presses the thermal head against the platen roller, and wherein the platen shaft and the head support shaft each have a cantilevered structure and are thus each supported only in a second direction, which is one of axial directions of the platen shaft and the rotating shaft.

2. The tape printing device according to claim 1, wherein the pressing member includes two convex portions that protrude toward the thermal head, that press the thermal head against the platen roller, and that are provided at different positions in an axial direction of the platen shaft.

3. The tape printing device according to claim 1, wherein the pressing member includes at least three convex portions that protrude toward the thermal head, that press the thermal head against the platen roller, and that are provided at different positions in an axial direction of the platen shaft.

4. The tape printing device according to claim 1, wherein the pressing member includes a plurality of convex portions that protrude toward the thermal head, that press the thermal head against the platen roller, that are provided at different positions in an axial direction of the platen shaft, and at least one of the plurality of convex portions is provided in a first direction, which is opposite to the second direction with respect to the rotating shaft, and at least another one of the plurality of convex portions is provided in the second direction.

5. The tape printing device according to claim 1, wherein the pressing member includes a first pressing portion provided with the convex portion, and a second pressing portion provided by bending at an end portion of the first pressing portion.

6. The tape printing device according to claim 1, wherein the convex portion is separated from the thermal head after the thermal head is moved to the separating position.

* * * * *